US011903474B1

(12) United States Patent
Schmeeckle

(10) Patent No.: US 11,903,474 B1
(45) Date of Patent: Feb. 20, 2024

(54) POWER CORD HOLDER FOR HAIR STYLING TOOLS

(71) Applicant: Janice Rae Schmeeckle, Ventura, CA (US)

(72) Inventor: Janice Rae Schmeeckle, Ventura, CA (US)

( * ) Notice: Subject to any disclaimer, the term of this patent is extended or adjusted under 35 U.S.C. 154(b) by 367 days.

(21) Appl. No.: 17/316,989

(22) Filed: May 11, 2021

(51) Int. Cl.
*A45D 20/12* (2006.01)
*A45D 1/06* (2006.01)
*A45D 1/00* (2006.01)

(52) U.S. Cl.
CPC ..... *A45D 20/12* (2013.01); *A45D 1/06* (2013.01); *A45D 2001/002* (2013.01)

(58) Field of Classification Search
CPC ..... A45D 20/12; A45D 1/06; A45D 2001/002
USPC ..... 383/71
See application file for complete search history.

(56) References Cited

U.S. PATENT DOCUMENTS 5,782,821 A * 7/1998 Couch ..... H01M 50/262 606/1
2005/0201642 A1* 9/2005 Terry ..... A45C 11/24 383/41
2015/0090749 A1* 4/2015 Moreau ..... A45F 5/00 224/191

* cited by examiner

*Primary Examiner* — Jes F Pascua
(74) *Attorney, Agent, or Firm* — Eric Karich; KARICH & ASSOCIATES

(57) ABSTRACT

A power cord holder has a storage body formed of a flexible material which extends to a perimeter that forms an opening, the storage body further being shaped to form an internal compartment. The power cord holder further includes a fastening system for constricting the perimeter so that the power cord is substantially contained within the internal compartment of the storage body; and a securing system for securing the power cord holder to the tool. The invention further includes a method for storing a hair styling tool having a power cord using the power cord holder, so that the power cord does not become tangled with other power cords or other items.

4 Claims, 2 Drawing Sheets

POWER CORD HOLDER FOR HAIR STYLING TOOLS

BACKGROUND OF THE INVENTION

Field of the Invention

This invention relates to a power cord holder that is adapted for containing a power cord of a hair styling tool.

Description of Related Art

Power cord holding devices are typically in the form of a rigid wall or desk-mounted retainer mechanism for retaining power cords of electronic devices. Most power cord holding devices are designed for organizing different power cords such as USB chargers, particularly in office settings. However, there exists a need for a more flexible, storage-friendly power cord holding device for the storage and/or transport of an electronic device, so that multiple electronic devices may be stored together without becoming tangled. This is particularly an issue in the field of beauty and hair care, where many hair styling tools are typically stored together in a drawer or similar storage space.

SUMMARY OF THE INVENTION

The present invention teaches certain benefits in construction and use which give rise to the objectives described below.

The present invention provides a power cord holder for storing a power cord of a tool. The power cord holder includes a storage body formed of a flexible material which extends to a perimeter that forms an opening, the storage body being shaped to form an internal compartment; a fastening system for constricting the perimeter so that the power cord is substantially contained within the internal compartment of the storage body; and a securing system for securing the power cord holder to the tool.

In another embodiment, the invention includes a method for storing a hair styling tool having a power cord. The power cord is positioned within the internal compartment such that the power cord extends out of the opening to the hair styling tool. The perimeter is closed with a fastening system so that the power cord holder is held on the power cord to maintain the power cord substantially contained within the internal compartment of the power cord holder.

A primary objective of the present invention is to provide a power cord holder, and method of use, having advantages not taught by the prior art.

Another objective is to provide a power cord holder that securely captures and stores a power cord so that the power cord does not become tangled with surrounding power cords or other items.

A further objective is to provide a method for storing a hair styling tool having a power cord that utilizes a fastening system for storing the power cord within a power cord holder.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a power cord holder 10 and a method for storing a tool 12, such as a hair styling tool, using the power cord holder 10 to secure a power cord 14 of the tool 12 using the power cord holder 10.

Figure 1:
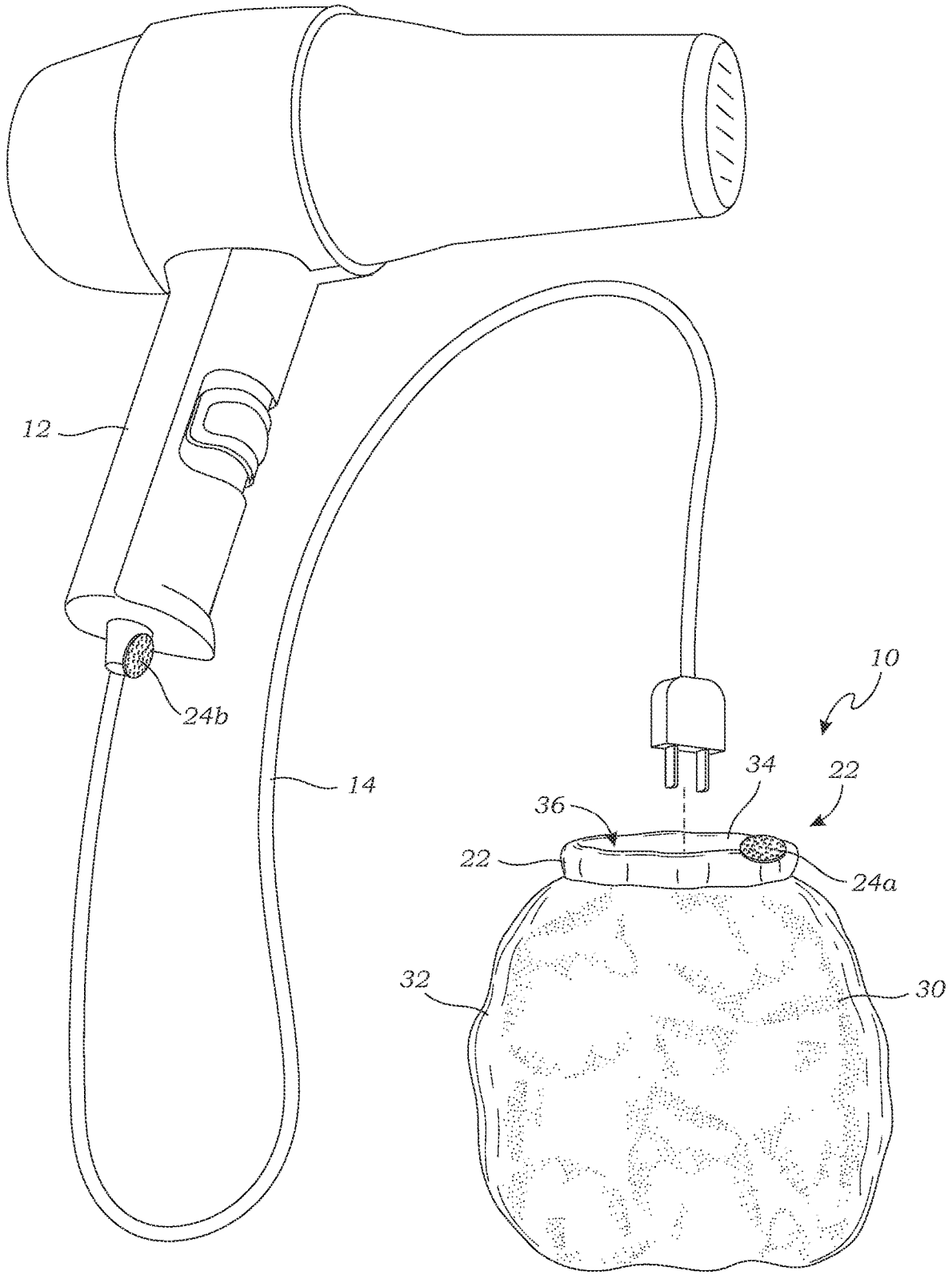
FIG. 1 is a perspective view of a power cord holder according to one embodiment of the present invention, illustrating a hair styling tool having a power cord positioned adjacent the power cord holder.
Figure 2:
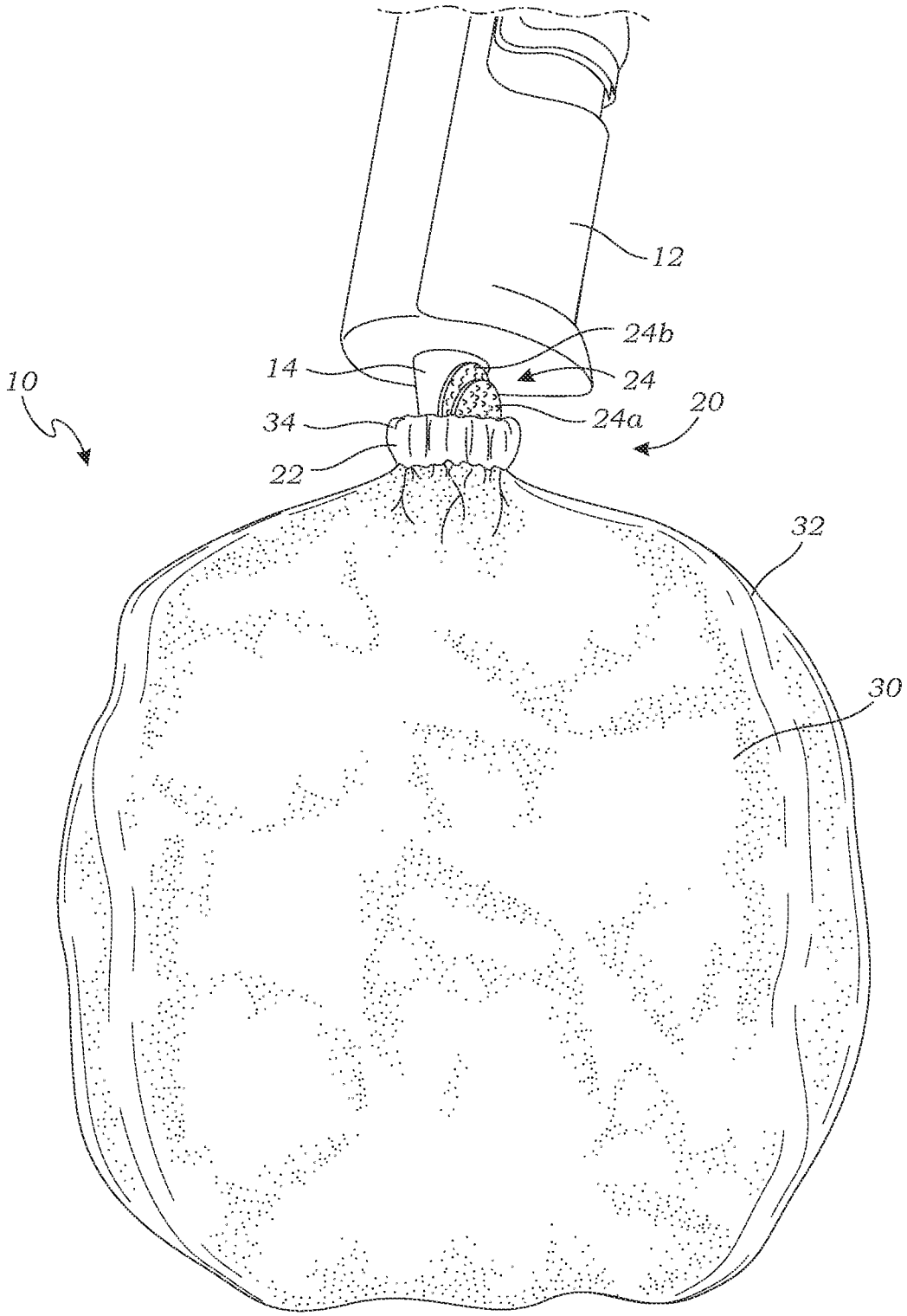
FIG. 2 is an up-close perspective view illustrating the power cord holder once the power cord of the hair styling tool has been positioned inside the power cord holder and fastened by a fastening system.

FIG. 1 is a perspective view of a power cord holder 10 according to one embodiment of the present invention, illustrating a hair styling tool 12 having a power cord 14 positioned adjacent the power cord holder 10. FIG. 2 is an up-close perspective view illustrating the power cord holder 10 once the power cord 14 of the hair styling tool 12 has been positioned inside the power cord holder 10 and fastened by a fastening system 20.

As shown in FIGS. 1-2, the power cord holder 10 comprises a storage body 30 formed of a flexible material, preferably of an elastic material, although inelastic materials may also be used in alternative embodiments. In some embodiments, the flexible material may be a blend of nylon with an elastic material such spandex, or it may be other suitable blends or materials (e.g., polyester, cotton, rayon, etc.). The storage body 30 extends to a perimeter 32 that forms an opening 34, the storage body 30 further being shaped to form an internal compartment 36. The internal compartment 36 is sized and adapted to contain the power cord 14 of the hair styling tool 12 such that the power cord 14 extends out of the opening 34 to the hair styling tool 12, and may be provided in a variety of sizes/dimensions to achieve this. The power cord holder 10 may be used with any form of tool, in this case a hair styling tool, and in particular in this case a hair dryer, although any form of hair styling tool may be used, discussed below.

The storage body 30 is sized to receive and contain the power cord, containing it securely in a somewhat compressed state to minimize the area required for storing the hair styling tool 12. For example, in some embodiments, the storage body is between 5-10 inches long and 2-6 inches wide. In the current embodiment, the storage body is about 7 inches long and 4 inches wide. Alternatively, the other lengths/dimensions may be used. As shown in FIGS. 1-2, in some embodiments, the hair styling tool 12 may be in the form of a blow dryer. However, in alternative implementations, the hair styling tool 12 may be in the form of a straightening brush or flat iron, curler, hot comb stove, etc., or any other hair styling tool having a power cord known in the art.

The power cord holder 10 further includes the fastening system 20 for closing the opening 34 of the perimeter 32. In some embodiments, the fastening system 20 is in the form of an elastic strip 22 attached to the opening 34 of the perimeter 32. The elastic strip 22 is stretched open to an open configuration, as shown in FIG. 1, but biases inwardly as shown in FIG. 2, to a closed configuration. In some embodiments, the elastic strip 22 is attached via stitching and is covered by the flexible material of the storage body 30, or positioned within an annular loop of the body, but alternatively the elastic strip 22 may be attached via any other means (e.g., a strong adhesive, inner loops, etc.). While an elastic strip 22 is currently used for the fastening system 20, other fasteners known in the art may alternatively be used, such as draw strings, snaps, hook and loop fasteners, and any other fasteners known in the art.

As shown in FIGS. 1-2, in this embodiment, the power cord holder 10 further includes a securing mechanism 24 for securing the power cord holder 10 to the hair styling tool 12. In this embodiment, the securing mechanism 24 is in the form of first and second fasteners 24*a* and 24*b*, in this case a hook and loop fastener, wherein a first hook or loop portion 24*a* is mounted on the storage body 30 (e.g., with an adhesive, or other method of attachment known in the art), in this case adjacent the opening 34, and an opposing hook or loop portion 24*b* is attached on the hair styling tool 12. The opposing hook or loop portion 24*b* may be attached on the hair styling tool 12 at any suitable location, but is preferably near where the power cord 14 intersects the body of the tool 12. The power cord holder 10 is then held in place once the power cord 14 is fully inside the storage body 30. In other embodiments, the securing mechanism 24 may be any other suitable securing mechanism, e.g., a button/loop, clasp, tie, etc. Furthermore, the fastening system 20 may include only the tightening or securing mechanism 22 or 24, a combination mechanism such as clips, strings, etc., or other form of fastening system known in the art, e.g., hooks, press-studs, etc.

In use, a user positions the power cord 14 of the hair styling tool 12 within the internal compartment 36 of the power cord holder 10 such that the power cord 14 extends out of the opening 34 to the hair styling tool 12. The perimeter 32 of the storage body 30 is then closed with the fastening mechanism 20. In this embodiment, the perimeter 32 is constricted at the opening 34.

The power cord holder 10 may then attached to the hair styling tool 12 via the securing mechanism 24. One of the fasteners 24*b* is attached to the tool 12 with an adhesive or other suitable method, preferably adjacent the power cord 14, to provide an attachment point. This allows the hair styling tool 12 to be quickly and easily stowed with many other similar tools, without the cords becoming tangled.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A power cord holder comprising:

a tool having a power cord;

a storage body formed of a flexible material which extends to a perimeter that forms an opening, the storage body being shaped to form an internal compartment;

a fastening system for constricting the perimeter so that the power cord is substantially contained within the internal compartment of the storage body; and a securing system for securing the power cord holder to the tool;

wherein the securing system includes a first hooks and loops fastener mounted on the storage body adjacent the perimeter of the storage body, and a second hooks and loops fastener that is mounted on the tool adjacent the power cord.

2. The power cord holder of claim 1, wherein the fastening system includes an elastic band.

3. The power cord holder of claim 1, wherein the storage body is about 7 inches long and 4 inches wide.

4. The power cord holder of claim 1, wherein the storage body is constructed of an elastic material.

* * * * *